US007447475B2

(12) United States Patent
Ishibe et al.

(10) Patent No.: US 7,447,475 B2
(45) Date of Patent: Nov. 4, 2008

(54) FIXING DEVICE AND IMAGE FORMING APPARATUS

(75) Inventors: Atsushi Ishibe, Hiratsuka (JP); Makoto Murata, Aiko-gun (JP); Kohji Kamiya, Yokohama (JP); Kazuo Uchida, Zama (JP); Motokazu Hasegawa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 11/613,587

(22) Filed: Dec. 20, 2006

(65) Prior Publication Data

US 2007/0140759 A1 Jun. 21, 2007

(30) Foreign Application Priority Data

Dec. 21, 2005 (JP) ..... 2005-368211

(51) Int. Cl.
*G03G 15/20* (2006.01)

(52) U.S. Cl. ..... 399/335; 399/329; 399/330

(58) Field of Classification Search ..... 399/320, 399/328, 329, 330, 335; 219/619; 347/156
See application file for complete search history.

(56) References Cited

U.S. PATENT DOCUMENTS 6,122,477 A * 9/2000 Parker ..... 399/330
6,320,168 B1 * 11/2001 Kimata et al. ..... 219/619
6,463,252 B2 * 10/2002 Omoto et al. ..... 399/330
6,725,009 B1 * 4/2004 Tatematsu et al. ..... 399/329
6,725,010 B1 * 4/2004 Parker ..... 399/330

FOREIGN PATENT DOCUMENTS

| | | | |
|---|---|---|---|
| JP | 2000-162912 | | 6/2000 |
| JP | 2000-214703 | | 8/2000 |
| JP | 2000-235329 | * | 8/2000 |
| JP | 2002-82549 | | 3/2002 |
| JP | 2006-11144 | | 1/2006 |

* cited by examiner

*Primary Examiner*—Sandra L Brase
(74) *Attorney, Agent, or Firm*—Oblon, Spivak, McClelland, Maier & Neustadt, P.C.

(57) ABSTRACT

A fixing device configured to fix a toner image onto a recording medium includes a coil for generating a magnetic flux and a heat generation member for generating heat by the magnetic flux; the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion which is positioned in the outer circumference plane side of the heat generation member, and a terminal portion for connecting both of the coil portions is provided between the inside coil portion and the outside coil portion.

8 Claims, 6 Drawing Sheets

FIXING DEVICE AND IMAGE FORMING APPARATUS

FIELD OF THE INVENTION

The present invention relates to an image forming apparatus such as a copying machine, printer, facsimile and complex machine thereof and to a fixing device disposed in the image forming apparatus, particularly, to a fixing device of electromagnetic induction heating type and an image forming apparatus.

BACKGROUND

As disclosed in JP2002-82549A, for example, there has been used a fixing device of electromagnetic induction heating type in an image forming apparatus such as a copying machine and printer, with the purpose of saving energy by reducing a starting up time of apparatus.

In the above JP2002-82549A, the fixing device of electromagnetic induction heating type comprises a supporting roller (heat generation roller), a fixing assist roller (fixing roller), a fixing belt stretched to the supporting roller and the fixing assist roller, an induction heating portion which faces the supporting roller via the fixing belt and a pressure roller which faces the fixing assist roller via the fixing belt. The induction heating portion comprises a coil portion (exciting coil) which is disposed to extend in the width direction (direction orthogonal to a transferring direction of recording medium) and a core which faces the coil portion.

The fixing belt is heated in a position facing the induction heating portion. The heated fixing belt heats a toner image on the recording medium which is transferred between the fixing assist roller and the pressure roller, so as to fix the toner image on the recording medium. More particularly, if high-frequency alternating current is applied to the coil portion, a magnetic field is formed around the coil portion; thereby, eddy current is generated adjacent to the surface of supporting roller. If the eddy current is generated to the supporting roller, Joule heat is generated by the electric resistance of the supporting roller itself. Accordingly, the fixing belt winded around the supporting roller is heated by Joule heat.

There has been known that such a fixing device of electromagnetic induction heating type can rise a surface temperature (fixing temperature) of the fixing belt to a desired temperature in a short starting up time with low energy On the other hand, there has been disclosed in JP2000-214703A a fixing device using an electromagnetic induction heating type which forms a core portion to sandwich a fixing belt. More particularly, the core portion of induction heating portion is disposed to face the outer circumference plane and the inner circumference plane of the fixing belt. This technique is aimed at improving the exothermic effect of the fixing belt.

There has been also disclosed in JP2000-162912A a fixing device using an electromagnetic induction heating type, which adjusts Curie point of a core portion (magnetic core) of induction heating portion in the width direction. More particular, the fixing device is formed such that Curie point of the core portion in the both end portions in the width direction becomes smaller than Curie point of the central portion in the width direction. This technique is aimed at controlling temperature up which occurs in the both end portions in the width direction of the fixing belt when a small size recording medium passes.

With respect to the above fixing devices, the present inventors has proposed a fixing device that a coil portion is arranged to sandwich front-back both planes of a heat generation member when using a member having Curie point (member capable of controlling a self temperature) as the heat generation member in order to prevent the excessive temperature up of heat generation member, because such arrangement increases the self temperature control performance of heat generation member, compared to when the coil portion which generates magnetic flux is arranged to face the main plane of heat generation member (reference to Japanese Patent Application No. 2005-140195).

As a device structure, it is necessary for the above fixing device to sandwich the front-back both planes inner and outer circumference planes) of heat generation member by means of a loop-shaped coil portion. The performance can be fully shown by this arrangement. When the fixing device using the electromagnetic induction heating type is utilized, the heat generation body is used as the supporting roller and the fixing belt is winded therearound, so it is necessary to support the supporting roller in a rotatable manner. More particularly, it is necessary to dispose a continued loop-shaped coil which passes the front-back both planes of the rotatably supported supporting roller having the fixing belt.

A litz wire is generally utilized as the loop-shaped coil. In order to ensure the fixing performance, it is necessary for the number of winding of litz wire to secure five times or more at minimum. In order to obtain this structure, at first, in a state that the supporting roller inserted into the inner circumference plane side of the fixing belt and a shaft bearing for rotating the supporting roller are disposed, it is necessary to repeat five times or more a step of passing the litz wire from the inner circumference plane to the outer circumference plane of the supporting roller and again passing the wire from the inner circumference plane. Moreover, in order to maintain the heat generation performance, it is necessary to arrange the litz wire in a correct position in series.

Explaining these steps as a practical operation, the litz wire having ø3 mm in an outer diameter is repeatedly inserted five times into the inner circumference plane side of the supporting roller having ø28.5 mm in an inner diameter to be retained in a predetermined position. Such an operation requires a lot of time. Moreover, it is difficult to avoid the generation of scratch to the already disposed litz wire caused by the insertion and contact of the litz wire. That is, the mass productivity is extremely low.

Since the assembled loop-shaped coil, fixing belt, supporting roller and shaft bearing are integrated, it has a poor handling ability. If a defect of component is found out which requires changing the component, it is almost impossible to change the component.

In addition, since the litz wire comprises a wire which bundles about 100 wires, each having about ø0.1 mm, the loopback of litz wire is required in the fixing device so as to obtain the number of winding of the coil. However, the litz wire can not be bent at a right angle because the litz wire is strong As a result, unnecessary spaces are required for placing the litz wire outside of the both end portions of supporting roller.

SUMMARY

In the above circumstances of the loop-shaped coil used for the fixing device using the electromagnetic induction heating type, it is an object of the present invention to provide a high productive and stable fixing device of electromagnetic induction heating type which has no possibility of generation of scratch to a litz wire and facilitates an assembling operation and an operation for changing a component, and also to provide an image forming apparatus.

In order to achieve the above object, the present invention is directed an a fixing device configured to fix a toner image onto a recording medium, comprising: a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, and a terminal portion for connecting both of the coil portions is provided between the inside coil portion and the outside coil portion.

According to the above structure, the heat generation member and the loop-shaped coil are assembled at one time, so a step of winding a coil is not required. Accordingly, an operating time can be significantly reduced. In addition, by using the end portion, the litz wire is supported without being bent, so an area occupied by the bent portions of litz wire can be reduced. Therefore, the fixing device can be downsized.

In accordance with an embodiment of the present invention, the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, and both of the coil supporting members are connected each other by the terminal supporting member.

According to the above structure, since each of the coil portions is supported by the coil supporting member, the litz wire can be incorporated into the coil supporting member in advance. Therefore, the loop-shaped coil can be easily assembled to the heat generation device.

In accordance with an embodiment of the present invention, the inside coil portion, which is disposed in the coil supporting member, and the outside coil portion, which is disposed in the coil supporting member, comprise a litz wire, each of the coil supporting members is provided with a connection electrode plate having a concave portion into which an end portion of the litz wire is inserted, for connecting the litz wire to the terminal portion, and a convex portion is formed in a bottom plane of the concave portion, which has contact with an end plane of the litz wire, and a side plane of the concave portion, which has contact with an outer circumference plane of the litz wire.

According to the above structure, it is possible to prevent the generation of contact defect of the litz wire for a long period of time without loosing the litz wire. In addition, by fastening a sleeve near the end portion of litz wire with caulking, the effect cart be improved.

In accordance with an embodiment of the present invention, the inside coil portion, which is disposed in the coil supporting member, and the outside coil portion, which is disposed in the coil supporting member, comprise a litz wire, and each of the coil supporting members includes a hole portion through which the litz wire penetrates to be retained According to the above structure, since the displacement of litz wire from the coil supporting member can be prevented by the hole portion, a coil gap can be always maintained; thus, a stable fixing performance can be obtained.

Also, the present invention is directed an image forming apparatus comprising a fixing device configured to fix a toner image onto a recording medium, the fixing device, including: a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, and a terminal portion for connecting both of the coil portions is provided between the inside coil portion and the outside coil portion.

Moreover, the present invention is directed to an image forming apparatus comprising a fixing device configured to fix a toner image onto a recording medium, the fixing device, including a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, a terminal portion for connecting both of the coil portions is provided between the inside coil portion and the outside coil portion, the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, and both of the coil supporting members are connected each other by the terminal supporting member.

Furthermore, the present invention is directed to an image forming apparatus, comprising a fixing device configured to fix a toner image onto a recording medium, the fixing device, including: a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, a terminal portion for connecting both of the coil portions is provided between the inside coil portion and the outside coil portion the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, both of the coil supporting members are connected each other by the terminal supporting member the inside coil portion, which is disposed in the coil supporting member, and the outside coil portion, which is disposed in the coil supporting member, comprise a litz wire, each of the coil supporting members is provided with a connection electrode plate having a concave portion into which an end portion of the litz wire is inserted, for connecting the litz wire to the terminal portion, and a convex portion is formed in a bottom plane of the concave portion, which has contact with an end plane of the litz wire, and a side plane of the concave portion, which has contact with an outer circumference plane of the litz wire.

Also, the present invention is directed to an image forming apparatus, comprising a fixing device configured to fix a toner image onto a recording medium, the fixing device, including: a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, a terminal portion for connecting both of the coil portions is provided between the inside coil portion and the outside coil portion the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, both of the coil supporting members are connected each other by the terminal supporting member, the inside coil portion, which is disposed in the coil supporting member, and the outside coil portion, which is disposed in the coil supporting member, comprise a litz wire, and each of the coil supporting members includes a hole portion through which the litz wire penetrates to be retained.

DESCRIPTION OF THE PREFERRED EMBODIMENT

Figure 1:
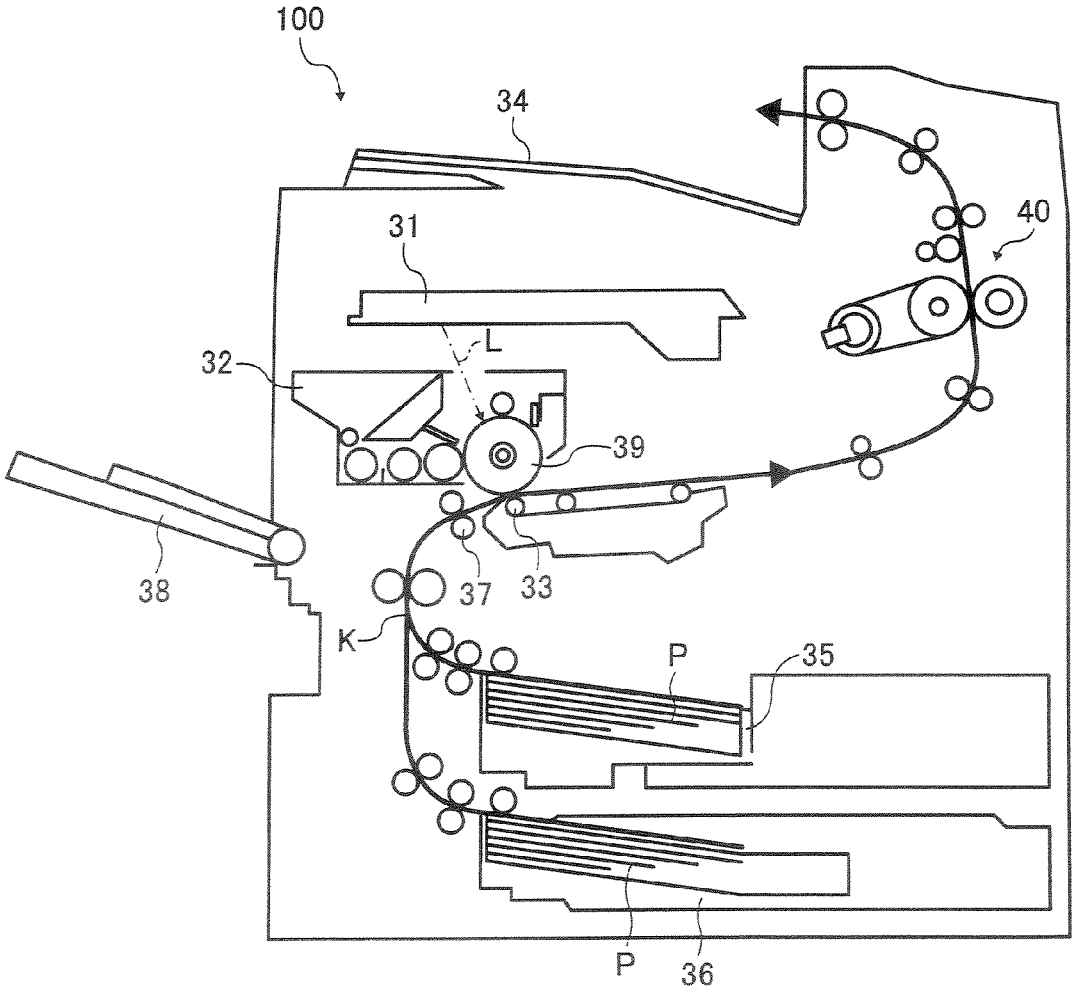
FIG. 1 is an entire structure view showing an image forming apparatus according to an embodiment of the present invention.

Hereinafter, an embodiment of the present invention will be explained with reference to the accompanying drawings. Whenever possible, the same reference numbers are used in the drawings and the description to refer to the same or like parts.

The embodiment of the present invention will be explained in details with reference to FIGS. 1-6. At first, an entire structure and operation of an image forming apparatus according to the present embodiment will be described with reference to FIG. 1. Referring to FIG. 1, reference number 100 denotes a body of an image forming apparatus. The image forming apparatus 100 comprises a laser printer including an exposure portion 31 for irradiating exposure light L based on image information onto a photoreceptor drum 39, a process cartridge 32 as an image forming portion, which is detachably disposed in the apparatus body, a transfer portion 33 for transferring a toner image formed on the photoreceptor drum 39 to a recording medium P, a discharging tray 34 on which an output image is placed, paper feeding portions 35, 36 in which the recording medium P such as a transfer paper is contained, a resist roller 37 for transferring the recording medium P to the transfer portion 33, a manual paper feeding portion 38, the photoreceptor drum 39 as an image carrier and a fixing device 40 for fixing an unfixed image on the recording medium P. The fixing device 40 is the fixing device according to the present embodiment to which the present invention is applied, and the description thereof will be described later.

A normal image forming operation with the image forming apparatus 100 will be described At first, the exposure light L such as a laser beam based on image information is emitted toward the surface of photoreceptor drum 39 of the process cartridge 32 from the exposure portion 31. The photoreceptor drum 39 rotates in the counterclockwise direction in the figure, and the toner image corresponding to the image information is formed on the photoconductor drum 39 via predetermined electro-photographic steps (charging step, exposure step, and developing step). After that, the toner image formed on the photoreceptor drum 39 is transferred by the transfer portion 33 onto the recording medium P which is transferred by the resist roller 37.

On the other hand, the recording medium P which is transferred to the transfer portion 33 operates as follows. At first, one of the plurality of paper feeding portions 35, 36, 38 of image forming apparatus body 100 is automatically or manually selected (for example, the top paper feeding portion 35 is selected). The top recording medium P of the recording media P housed in the paper feeding portion 35 is transferred toward a position of a transferring path K. After that, the recording medium P passes the transferring path P, and reaches the position of resist roller 37. The recording medium P which has reached the position of resist roller 37 is transferred toward the transfer portion 33 in timing so as to position the recording medium P to the toner image formed on the photoreceptor drum 39.

After passing through the position of transfer portion 33, the recording medium P after the transfer step reaches the fixing device 40 via the transferring path, and the toner image is fixed on the recording medium P by the fixing device 40 as described later. The recording medium P sent from the fixing device 40 is discharged from the image forming apparatus body 100 as an output image, and is placed on the discharge tray 34. Accordingly, a series of image forming process is completed.

Figure 2:
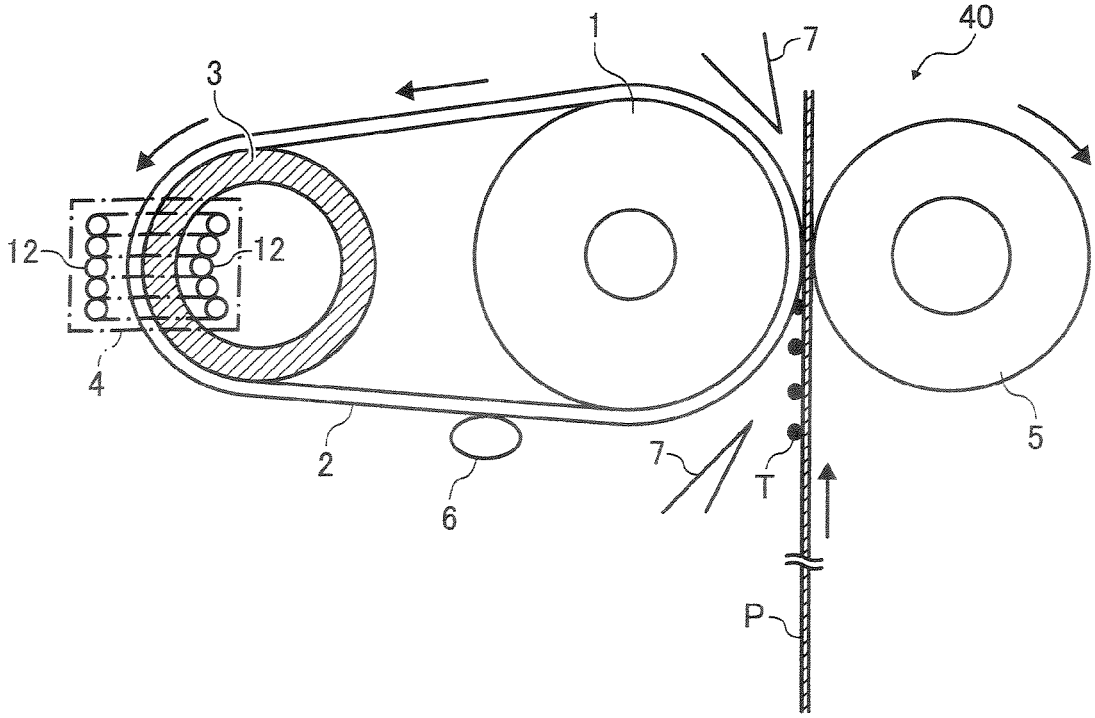
FIG. 2 is a cross section view showing a fixing device according to the embodiment of the present invention.

FIG. 2 is a cross section view of the fixing device 40 according to the embodiment of the present invention. The structure and operation of fixing device 40 according to the embodiment will be explained with reference to FIG. 2. As illustrated in FIG. 2, the fixing device 40 mainly comprises a fixing roller 1, a fixing belt 2, a supporting roller 3, an induction heating device 4, a pressure roller 5, a thermistor 6 and a guide plate 7.

The fixing roller 1 has an elastic layer such as a silicone rubber provided on a surface of an iron core such as a stainless steel. Preferably, the elastic layer has 3 mm-10 mm in a radial thickness and 10-50° in Asker hardness.

The supporting roller 3 as a heat generation member includes a heat generation portion (cylinder portion) comprising a magnetic conductive material. Its radial thickness is about 0.6 mm. The supporting roller 3 is provided with shaft bearings 11, 11 (reference to FIG. 6A) to be rotatably retained.

The fixing belt 2 has an elastic layer provided on a substrate comprising a high-temperature resin material such as a polyamide and a releasing layer provided on the elastic layer. The fixing belt 2 is stretched to the supporting roller 3 and the fixing roller 1 to be retained.

The pressure roller 8 has an elastic layer provided on a core such as an aluminum and a releasing layer provided on the elastic layer. Similar to the supporting roller 3, the fixing roller 1 and pressure roller 5 are rotatably retained by shaft bearings.

The fixing roller 1 is driven by a driving portion (not shown). The fixing roller 1 and supporting roller 3 rotate in the counterclockwise direction in FIG. 2. The fixing belt 2 is stretched to the supporting roller 3 and fixing roller 1 to be supported, and moves according to the rotation of fixing roller 1 and supporting roller 3. The recording medium P which has reached the fixing device 40 via the transferring path from the transfer portion 33 is fed between the fixing roller 1 and the pressure roller 5 via the fixing belt 2. The toner image T is fixed on the recording medium P by the heat received from the fixing belt 2 and the pressure received from the pressure roller 5. The recording medium P on which the toner image T is fixed is discharged between the fixing belt 2 and the pressure roller 5 via the guide plate 7.

The induction heating device 4 comprises a loop-shaped coil including litz wires 12, 12 as an inside coil portion, an outside coil portion (and aftermentioned terminal portions) as described later. The litz wires 12, 12 are disposed to face the front-back both planes (outer circumference plane and inner circumference plane) of the supporting roller 3. Alternate current of 10 k-1 MHz (preferably, 10 k-300 kHz) is applied to the loop-shaped coil from a high frequency power source portion (not shown).

In addition, the supporting roller 3 as the heat generation member may use a magnetic conduction material such as a nickel, iron, chrome or their mixed metal as a material. It is possible to obtain desired Curie point by adjusting the additive amount and the processing condition of each material. As just described, if the supporting roller 3 is formed with the magnetic conduction material that Curie point approaches a fixing temperature of the fixing belt 2, the supporting roller 3 is heated without excessively increasing its temperature by the electromagnetic induction. More particularly, if the temperature of supporting roller 3 (its heat generation layer) exceeds Curie point, the heat generation of supporting roller 3 is controlled. More particularly, if the temperature of supporting roller 3 heated by the induction heating device 4 exceeds Curie point, the generation of excess current near the surface is controlled because the supporting roller 3 looses the magnetism. Thereby, the amount of generation of Joule heat is reduced in the supporting roller 3, and the excessive temperature up is controlled.

Figure 6A:
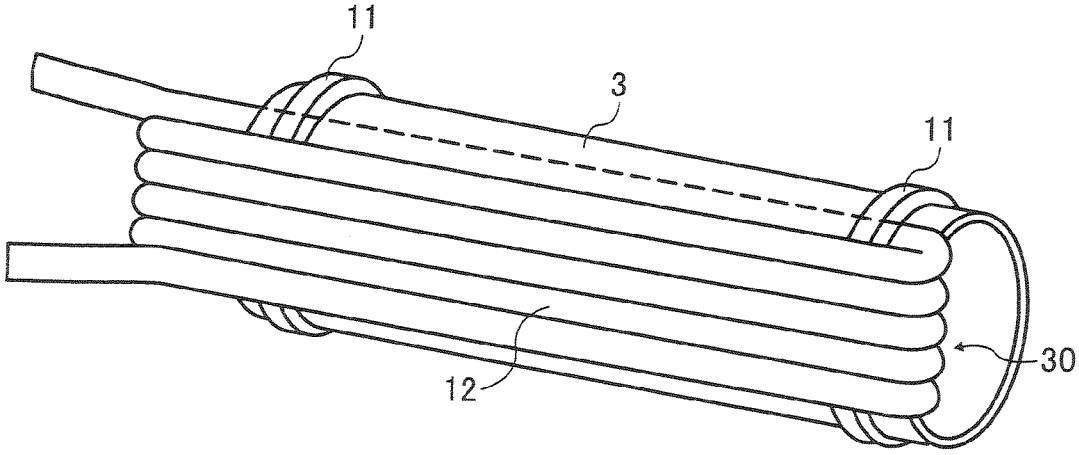
FIGS. 6A, 6B are views showing an induction heating device of a comparative example according to the embodiment of the present invention.
Figure 6B:
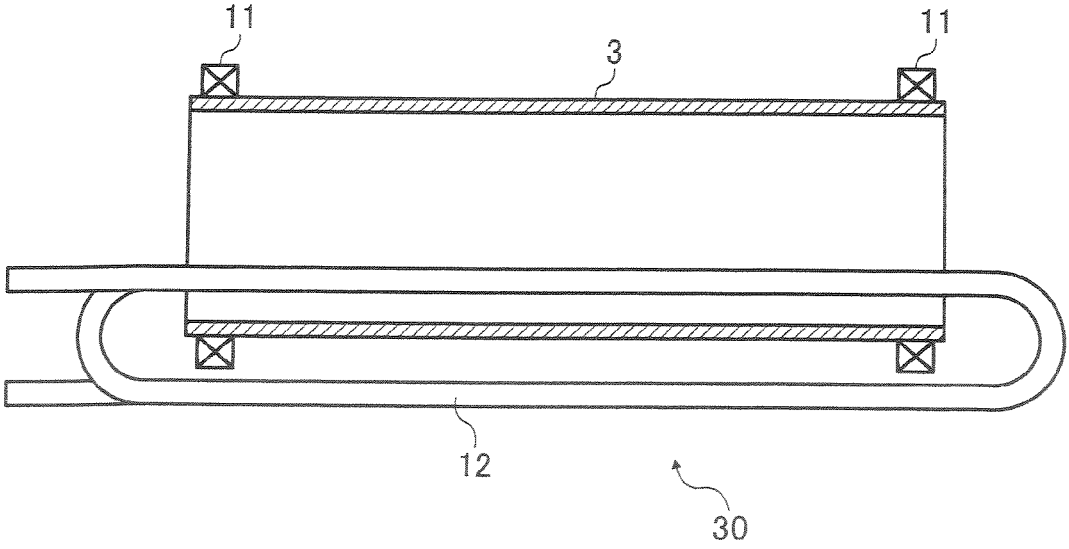

In this case, it is a problem if an induction heating device 30 shown in FIGS. 6A, 6B is used instead of the induction heating device 4. The induction heating device 30 is formed such that a supporting roller 3, the shaft bearings 11 and a fixing belt 2 are winded by a litz wire 12. Such a structure anticipates that the litz wire 12 is not easily removed. On the other hand, the following induction heating device 4 according to the embodiment of the present invention can solve the above problem.

Figure 3:
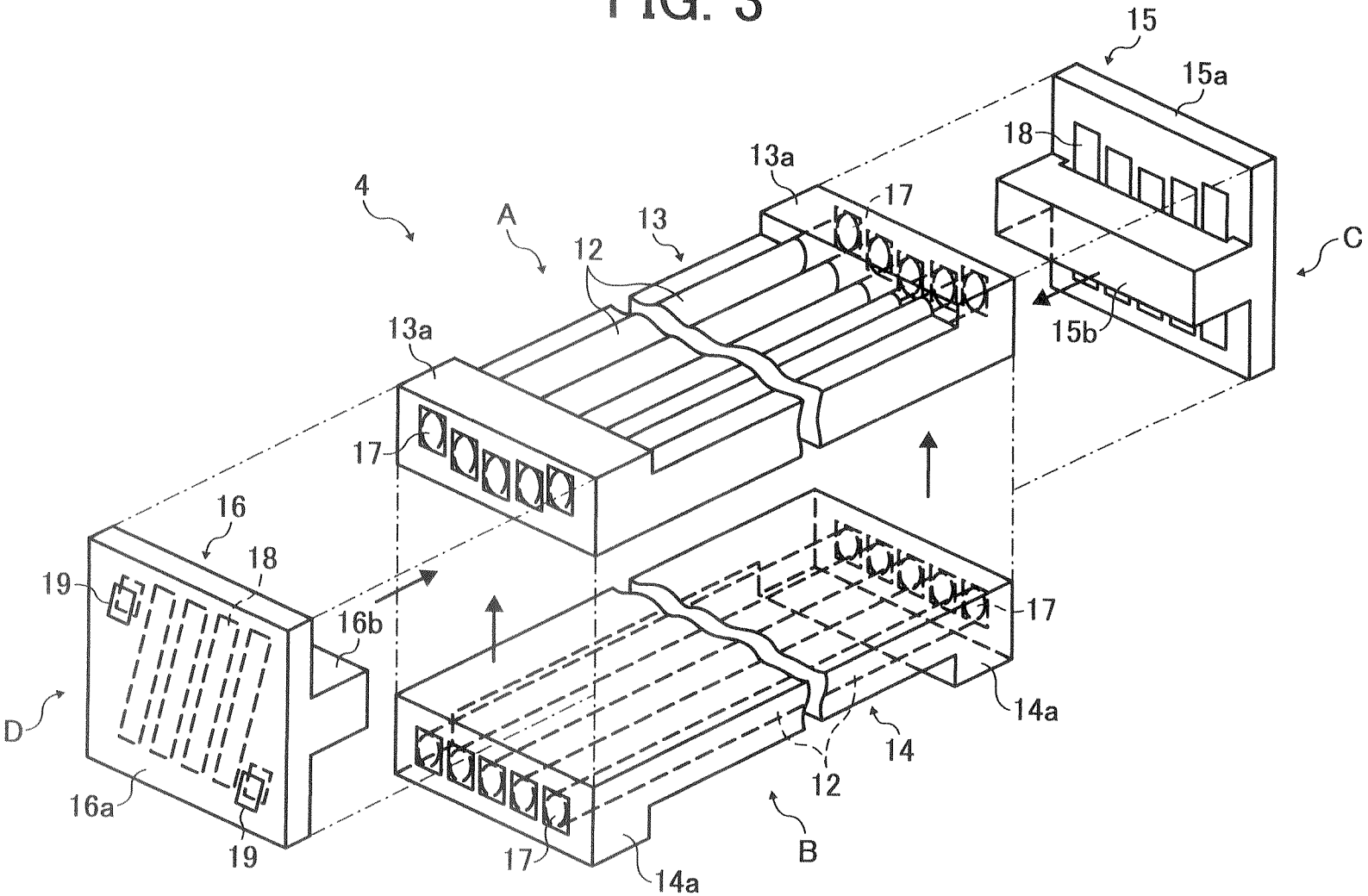
FIG. 3 is an exploded perspective view showing an induction heating device according to the embodiment of the present invention.
Figure 4:
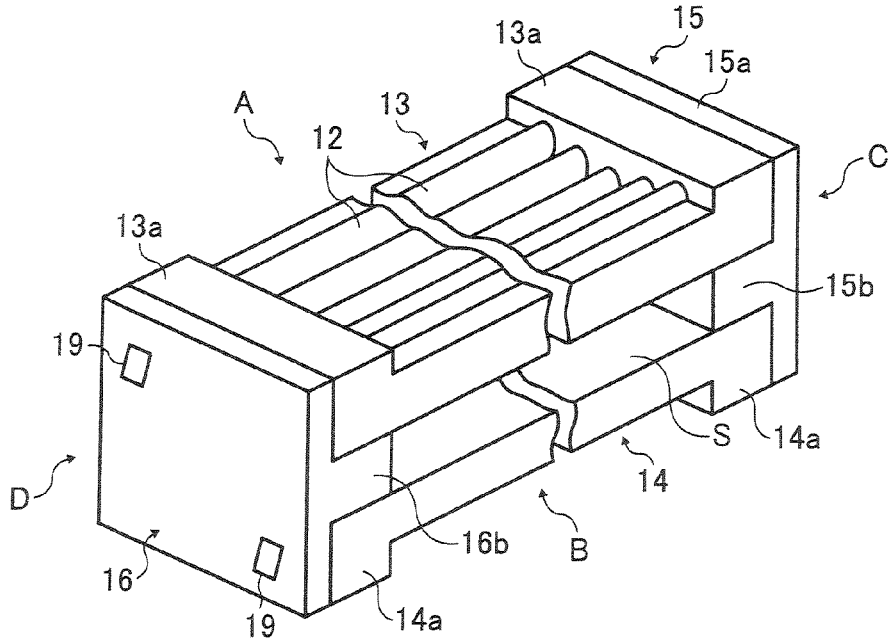
FIG. 4 is a perspective view illustrating the assembled state of the induction heating device according to the embodiment of the present invention.

FIG. 3 shows an explored explanation view of the induction heating device 4 according to the embodiment. FIG. 4 is a perspective view showing the assembled state of the induction heating device 4. The induction heating device 4 mainly comprises an inside coil unit A including a coil supporting member 13, an outside coil unit B including a coil supporting member 14 and terminal units C, D including terminal supporting members 15, 16, respectively. Each of these members is molded by a high-temperature resin or the like as a base material.

Each of the coil supporting members 13, 14 comprises a tray shape having end portions 13*a*, 13*a*, 14*a*, 14*a*. The required number of straight litz wires 12 is disposed in each of the coil supporting members 13, 14. In this embodiment, five litz wires are disposed in each of the coil supporting members 13, 14, and each of the litz wires 12 has the both end portions fixed to connection electrode plates 17, respectively, provided in the each of the end portions 13*a*, 13*a*, 14*a*, 14*a*. In addition, the five litz, wires 12 provided in the coil supporting member 13 of the inside coil unit A is arranged in a circular arc shape such that the center portion of the five wires becomes the closest to the outside coil unit B.

Figure 5A:
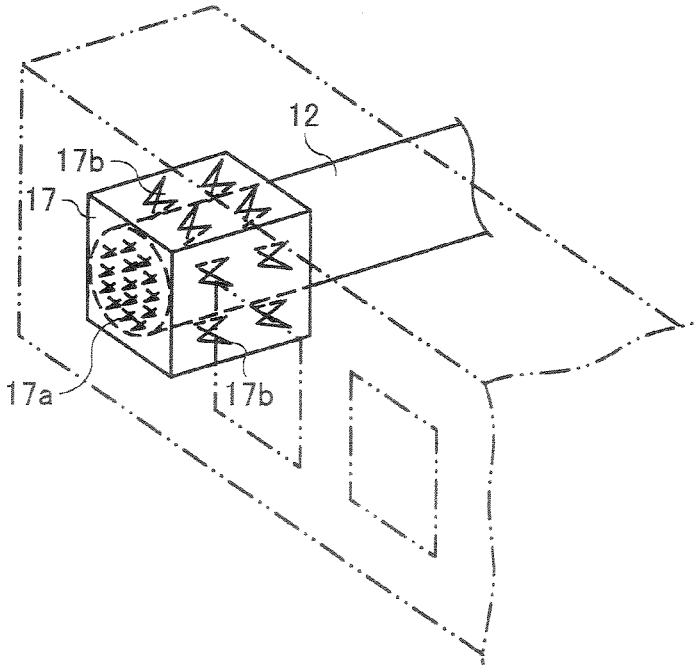
FIGS. 5A, 5B, 5C are views showing a detail and a modification example of the induction heating device according to the embodiment of the present invention

It is desirable for the contact between the end planes of each of the litz wires 12 and connection electrode plates 17 of the end portions 13*a*, 13*a*, 14*a*, 14*a* of each of the coil supporting members 13, 14 to use soft soldering or super sonic weld because strong contact therebetween is required. In the embodiment, as a simple method, each of the connection electrode plates 17 comprises a box shape formed with a concave portion into which the end portion of litz wire is inserted. In addition, as illustrated in FIG. 5A, each of the connection electrode plates 17 has a plane, which has contact with the cut plane (end plane) of each of the litz wires 12 (the bottom plane of the concave portion formed in the connection electrode plate 17), provided with tiny convex portions 17*a*, so as to ensure the contact points with each of the litz wires 12. Each of the connection electrode plates 17 also has the side plane, which has contact with the outer circumference plane of each of the litz wires 12 (the side plane of the concave portion formed in the connection electrode plate 17), provided with sharp and large convex portions 17*b*. The convex portions 17*b* bite into the outer circumference plane of each of the litz wires 12 to firmly support each of the litz wires, The terminal supporting member 15 comprises a base plate 15*a* and a spacer portion 15*b* formed in the substantially center of the base plate 15*a*, Also, the terminal supporting member 16 comprises a base plate 16*a* and a spacer portion 16*b* formed in the substantially center of the base plate 16*a*. A slit is provided between each of the spacer portions 15*b*, 16*b* and each of the plates 16*a*, 16*a*. Each of the base plates 15*a*, 16*a* is provided with terminal plates 18 through the slit. Five terminal plates 18 are disposed in the terminal supporting member 15 of the terminal unit C orthogonal to the spacer portion 15*b*, and four terminal plates 18 are disposed in the terminal supporting member 16 of the other terminal unit D.

Also, the base plate 16*a* of terminal supporting member 16 has an upper end portion and a lower end portion provided with an electrode portion 19, 19.

The end plane of litz wire 12, which is disposed in the innermost side seen by FIG. 3 in the five litz wires 12 provided in the inside coil unit A, is connected to the electrode portion 19 disposed in the upper end portion of the base plate 16*a*. The end plane of litz wire 12, which is disposed in the outermost side seen by FIG. 3 in the five litz wires 12 provided in the outside coil unit B, is connected to the electrode portion 19 disposed in the lower end portion of the base plate 16*a*.

Each of the four terminal plates 18 provided in the terminal unit D extends along the up and down direction of the terminal unit D and is disposed to slop the extending direction in the lateral direction of the base plate 16*a* relative to the up and down direction of the terminal unit D, such that each of the four litz wires 12 of the inside coil unit A except the litz wire 12 connected to the electrode portion 19 of the upper end portion of the base plate 16*a* is connected to each of the four litz wires 12 of the outside coil unit B except the litz wire 12 connected to the electrode portion 19 of the lower end portion of the base plate 16*a* in order from one side to the other side of the lateral direction of the base plate 16*a* via each of the terminal plates 18.

As shown in FIG. 4, in the assembled state, the inside coil unit A and the outside coil unit B are disposed to face each other. The terminal units C, D are fitted to the both sides of the inside coil unit A and the outside coil unit B. Namely, the spacer portion 15*b* of the terminal supporting member 15 and the spacer portion 16*b* of the terminal supporting member 16 are disposed between the end portions 13*a*, 13*a* of the coil supporting member 13 and the end portions 14*a*, 14*a* of the coil supporting member 14, respectively, so as to form a space S for the heat generation member between the inside coil unit A and the outside coil unit B. The supporting roller 3 (and the fixing belt 2) is provided in this space S.

Moreover, in the assembled state, the connection electrode plates 17 of the inside coil unit A and the connection electrode plates 17 of the outside coil unit B are electrically connected by the terminal plates 18 of terminal units C, D, respectively. In this case, as shown in FIG. 3, the five litz wires 12 of the inside coil unit A face the five litz wires 12 of the outside coil unit B in parallel, and the litz wires which face each other are connected by each of the terminal plates 18 in the terminal unit C. On the other hand, since each of the terminal plates 18 in the other terminal unit D is disposed at an angle, as described above, each of the litz wires 12 of inside coil unit A is connected to the litz wire 12 of the outside coil unit B with appropriate shift of one wire in the lateral direction of the base plate 16*a* via each of the terminal plates 18. Thereby, the litz wires 12, connection electrode plates 17 and terminal plates 18 comprise the loop-shaped coil which surrounds the space S. In addition, the high frequency power source portion which applies the alternate current is connected to the electrode portions 19, 19 of terminal unit D. Each of the litz wires 12 of inside coil unit A corresponds "the inside coil portion", each of the litz wires 12 of outside coil unit B corresponds "the outside coil portion" and each of the terminal plates of terminal units C, D corresponds "the terminal portion".

Next, the Sing device 40 is assembled as follows. At first, the supporting roller 3 is inserted in the fixing belt 2, and the shaft bearings 11 (FIGS. 6A, 6B) are assembled to the both ends of the supporting roller 3, respectively. In this state, the inside coil unit A is inserted in the supporting roller 3 to which fixing belt 2 is stretched and the shaft bearings 11 are assembled. The outside coil unit B is disposed in a position facing the inside coil unit A. The terminal units C, D, which are electrically and mechanically connected to the coil supporting member 13 of the inside coil unit A and the coil supporting member 14 of the outside coil unit B, are installed. Thereby, the fixing belt 2, supporting roller 3 and loop-shaped coil portion disposed therearound are completed. In addition, if a plate spring is disposed in the back plane side of each of the terminal supporting members 15, 16, the contact between electrode plates is stabilized over time. Finally, the fixing belt 2, supporting roller 3 and induction heating device 4 (loop-shaped coil portion), which are integrated together, are assembled to the fixing device 40, and the assembling of fixing device 40 is completed by connecting the electrode portions 19, 19 of terminal unit D to the high frequency power source portion.

As a result, the loop-shaped coil is disposed to sandwich the inner and outer circumference planes of the supporting roller 3, which generates heat, so the target performance of heat generation member (supporting roller 3) can be brought out. At the same time, it is possible to obtain advantages such as reduction in the operation time for winding the coil in the assembling, prevention of generation of scratch caused by the contact between the litz wire and the supporting roller, stabilization in the disposition of litz wires in the inner circumference plane side and the outer circumference plane side of the supporting roller, and space saving around the coil loopback portions.

In the above explanation, after the coil supporting members 13, 14 for the inner and outer circumference planes are assembled to the supporting roller 3 including the fixing belt 2, the supporting roller 3 is assembled to the fixing device 40. However, in the assembling of the fixing device 40, the coil supporting member 13 of the inside coil unit A is previously retained in the fixing device 40, and then the outside coil unit B (coil supporting member 14) may be assembled to the fixing device 40 after inserting the fixing belt 2 and the supporting roller 3. According to the number of assembling steps, this method may be suitable.

In the above embodiment, the supporting roller 3 is heated by the induction heating device 4 (loop-shaped coil portion), but as the induction heating portion, the same effect can be obtained by a method of heating a heat generation member disposed in the fixing belt 2 or a method of heating another heat generation member disposed in the inner face of the fixing belt 2.

Figure 5B:
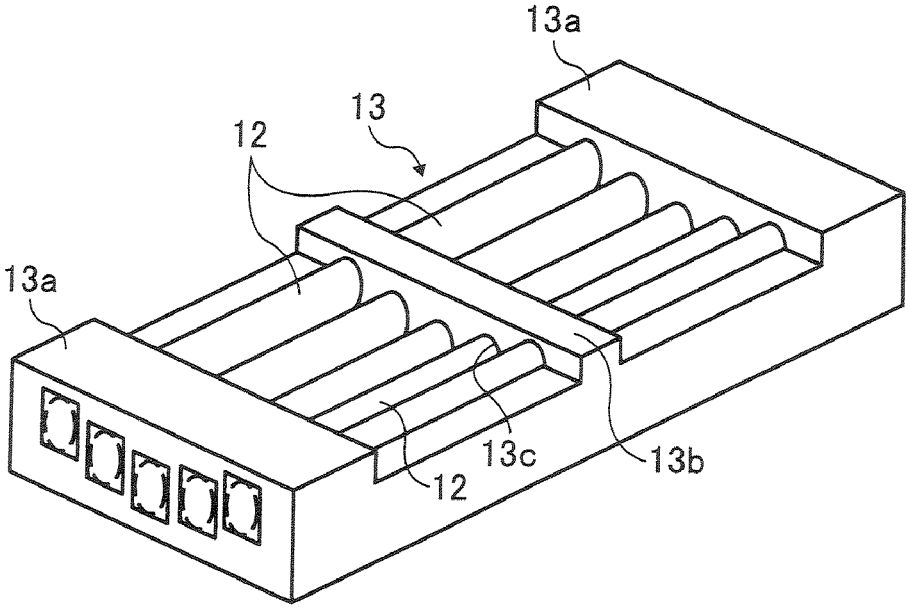

In addition, the litz wires 12 are simply disposed in the coil supporting members 13, 14 for supporting the litz wires 12. However, there may be a possibility that the litz wires 12 are displaced over time by the vibration, gravity or the like. As the countermeasure, a method of fastening the disposed litz wires 12 by coating an epoxy resin or the like on the outer circumference planes of the litz wires 12, or as shown in FIG. 5B, a method of preventing the displacement of litz wires 12 by disposing a retaining portion 13*b* and hole portions 13*c* in a part of the coil supporting member 13 and passing the litz wires 12 into the holes 13*c*, respectively, to retain the litz wires 12 can be adopted. Moreover, FIG. 5B shows the example for the coil supporting member 13 of the inside coil unit A, but such a method can be adopted for the coil supporting member 14 of the outside coil unit B.

Figure 5C:
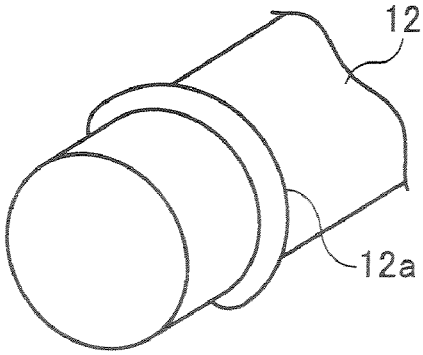

FIG. 5C shows the details in the end portion of litz wire 12. If a sleeve 12*a* is fastened to the end portion of litz wire 12 by caulking; the convex portions 17*b* of the connection electrode plate 17 shown in FIG. 5A, which have contact with the outer circumference plane of litz wire 12, interfere with the sleeve 12*a*. Thereby, it is possible to prevent the litz wire 12 from falling off.

A fixing belt 2 having ø60 mm in a removed state and a supporting roller 3 having ø30 mm in an outer diameter and ø28.5 mm in an inner diameter are used. A temperature compensator alloy that Curie point is a fixable temperature and becomes 300° C. or less is used as material of the supporting roller 3. The litz wire that 200 wires, each having ø0.2 mm, are bundled is used for the loop-shaped coil, and the number of winding of litz wires is five times. In the fixing device using the above components, if the terminal portions and coil supporting members according to the present invention are used, the step of winding the coil is not required when incorporating the litz wire in the device; thereby, it is possible to lower more than half of the operation tack in case of assembling the fixing device. Also, the generation of scratch by the contact between the litz, wires becomes zero, and the coil in the inner circumference plane of supporting roller is disposed in a target position, and also a position (gap) between the coils which sandwich the supporting roller can be stably secured, so a target heating performance can be constantly obtained.

In addition, the present invention is adoptable for a device which comprises a closed loop with a coil member over inner and outer circumference planes of a hollow cylinder body.

In the fixing device of electromagnetic induction heating type according to the present invention, in which the coil is disposed to sandwich the front-back both planes (inner and outer circumference planes) of the heat generation member, since the connection portions are provided in the loop-shaped coil, the loop-shaped coil is completed via the connection portions. Accordingly, the coil portion, coil supporting member and heat generation member are separately structured, so these are assembled at once. Especially, the coils can be disposed in the coil supporting member in advance, so the operation of winding a coil in a state that the supporting roller and shaft bearings are assembled is not required. In addition, since the assembled coil and heat generation member can be easily disassembled, a component can be easily changed when a component defect is found out.

The present application is based on and claims priority from Japanese application No. 2005-368211, filed on Dec. 21, 2005, the disclosures of which are hereby incorporated by reference herein in their entirety, Although the present invention has been described in terms of exemplary embodiment, it is not limited thereto. It should be appreciated that variations may be made in the embodiment described by persons skilled in the art without departing from the scope of the present invention as defined by the following claims. In addition, the number, position, shape, or the like of the component are not limited to the above embodiment, and can be changed to the number, position, shape or the like of the component preferable for conducting the present invention. Moreover, no element and component in the present disclosure is intended to be dedicated to the public regardless of whether the element or component is explicitly recited in the following claims.

What is claimed is:

1. A fixing device configured to fix a toner image onto a recording medium, comprising:

a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, and a terminal portion for connecting both of the coil portions is provided between the inside coil portion and the outside coil portion.

2. The fixing device according to claim 1, wherein the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, and both of the coil supporting members are connected each other by the terminal supporting member.

3. The fixing device according to claim 2, wherein the inside coil portion, which is disposed in the coil supporting member, and the outside coil portion, which is disposed in the coil supporting member, comprise a litz wire, each of the coil supporting members is provided with a connection electrode plate having a concave portion into which an end portion of the litz wire is inserted, for connecting the litz wire to the terminal portion, and a convex portion is formed in a bottom plane of the concave portion, which has contact with an end plane of the litz wire, and a side plane of the concave portion, which has contact with an outer circumference plane of the litz wire.

4. The fixing device according to claim 2, wherein the inside coil portion, which is disposed in the coil supporting member, and the outside coil portion, which is disposed in the coil supporting member, comprise a litz wire, and each of the coil supporting members includes a hole portion through which the litz wire penetrates to be retained.

5. An image forming apparatus comprising a fixing device configured to fix a toner image onto a recording medium, the fixing device, including:

a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, and a terminal portion for connecting both of the coil portions is provided between the inside coil portion and the outside coil portion.

6. An image forming apparatus comprising a fixing device configured to fix a toner image onto a recording medium, the fixing device, including:

a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, a terminal portion for connecting both of the coil portions is provided between the inside coil portion and the outside coil portion, the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, and both of the coil supporting members are connected each other by the terminal supporting member.

7. An image forming apparatus, comprising a fixing device configured to fix a toner image onto a recording medium, the fixing device, including:

a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided in an inside coil portion, which is positioned in the inner circumference plane side of the heat generation member, and an outside coil portion, which is positioned in the outer circumference plane side of the heat generation member, a terminal portion for connecting both of the coil portions is provided between the inside coil portion and the outside coil portion the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, both of the coil supporting members are connected each other by the terminal supporting member the inside coil portion, which is disposed in the coil supporting member, and the outside coil portion, which is disposed in the coil supporting member, comprise litz wire, each of the coil supporting members is provided with a connection electrode plate having a concave portion into which an end portion of the litz wire is inserted, for connecting the litz wire to the terminal portion, and a convex portion is formed in a bottom plane of the concave portion, which has contact with an end plane of the litz wire, and a side plane of the concave portion, which has contact with an outer circumference plane of the litz wire.

8. An image forming apparatus, comprising a fixing device configured to fix a toner image onto a recording medium, the fixing device, including:

a coil for generating a magnetic flux; and a heat generation member for generating heat by the magnetic flux, wherein the heat generation member includes a hollow cylinder shape, the coil has a loop-shaped coil disposed in a loop shape to sandwich inner and outer circumference planes of the heat generation member of the hollow cylinder shape, the loop-shaped coil is divided into an inside coil portion, which is positioned in the inner circumference plane side of the heat generation member, and an outside coil portion, which is positioned in the outer circumference plane side of the heat generation member, a terminal portion for connecting both of the coil portions is provided between the inside coil portion and the outside coil portion the outside coil portion is supported by a coil supporting member, which is disposed in the outer circumference plane side of the heat generation member to support the outside coil portion, the inside coil portion is supported by a coil supporting member, which is disposed in the inner circumference plane side of the heat generation member to support the inside coil portion, the terminal portion is supported by a terminal member, which supports the terminal member, both of the coil supporting members are connected each other by the terminal supporting member, the inside coil portion, which is disposed in the coil supporting member, and the outside coil portion, which is disposed in the coil supporting member, comprise a litz wire, and each of the coil supporting members includes a hole portion through which the litz wire penetrates to be retained.

* * * * *